United States Patent [19]

Policht et al.

[11] Patent Number: 4,925,779

[45] Date of Patent: May 15, 1990

[54] PHOTO STRIP PROTECTION METHOD AND PRODUCT

[75] Inventors: Stanislaw A. Policht, Closter, N.J.; Gerard Vernice, Whitestone, N.Y.

[73] Assignee: Qualex, Inc., Durham, N.C.

[21] Appl. No.: 288,450

[22] Filed: Dec. 22, 1988

[51] Int. Cl.[5] ..... G03C 1/76; G03C 3/00

[52] U.S. Cl. ..... 430/403; 430/11; 430/432; 430/496; 430/501; 430/961; 428/192; 428/193

[58] Field of Search ..... 430/403, 432, 496, 501, 430/961, 11; 428/192, 193

[56] References Cited

U.S. PATENT DOCUMENTS

| | | | |
|---|---|---|---|
| 1,943,990 | 1/1934 | Pedersen . | |
| 2,608,127 | 8/1952 | Redfield . | |
| 2,797,804 | 7/1957 | Pomeroy et al. . | |
| 3,041,196 | 6/1962 | Stella . | |
| 3,531,193 | 9/1970 | Diehl . | |
| 3,539,344 | 5/1967 | Russell | 430/961 |
| 3,945,079 | 3/1976 | Westberg . | |
| 4,026,756 | 5/1977 | Stanfield et al. . | |
| 4,077,830 | 3/1978 | Fulwiler | 430/11 |
| 4,452,523 | 6/1984 | Douglas . | |
| 4,657,805 | 4/1987 | Fukumitsu et al. . | |

*Primary Examiner*—Paul R. Michl
*Assistant Examiner*—Thorl Chea
*Attorney, Agent, or Firm*—Kinzer, Plyer, Dorn, McEachran & Jambor

[57] ABSTRACT

A photo negative strip including a sequence of individual photo frames is protected by laminating two slightly narrower strips of transparent protective film onto the opposed surfaces of the photo strip; each protective strip is removably secured to the photo strip by two edge stripes of a pressure sensitive releasable adhesive. The adhesive stripes covers the sprocket holes near the edges of the photo strip, but edge portions of the photo strip are left, uncovered by either protective film, along both outer edges of the photo strip. The preferred protective film is of biaxially oriented polystyrene.

28 Claims, 2 Drawing Sheets

PHOTO STRIP PROTECTION METHOD AND PRODUCTcl BACKGROUND OF THE INVENTION

When taken by amateurs, as most are, photographs usually start as a sequence of exposed segments or frames extending longitudinally of a photographic film. When the film in a camera has been exposed in its entirety, it is removed by the amateur photographer, usually in a cartridge of some kind, and taken to a film development store, a camera shop, a drugstore, or other such establishment for development. Ordinarily, the retail establishment that first gets the film does not actually develop it; the photo film is usually sent to a central location where it is developed and prints or slides of the pictures are made. When this processing has been completed, the original photo film is cut into discrete photo strips and is returned to the retail establishment and then to the photographer, along with the prints or slides that have been made from it.

Sooner or later, the photographer may desire to obtain additional prints of one or more of the pictures appearing in one of the photo strips. In some instances, enlargements of all or portions of the pictures may be desired. At this point some critical problems are likely to appear. Thus, the negative images on the original photo strip may have become scratched or otherwise damaged due to inept handling either at the time of development or, more frequently, when in the hands of the photographer. Dust, lint, food, and a wide variety of other foreign substances may have come in contact with and adhered to the photo strip containing the images to be reproduced. In either case, it is necessary to clean the film or to touch it up in order to get a good reproduction or enlargement of the picture. Indeed, sometimes any reproduction may be flawed, particularly if the original photo strip has been scratched or otherwise marred.

Some techniques for protecting photo strips in order to preserve them in better condition for later reproduction of their pictures have been developed and have been utilized in the marketplace. Thus, chemical protective coatings have been applied to some photo strips, by the developing companies, in order to preserve them in better condition for subsequent reproduction. However, the protective coatings thus applied may themselves be scratched, though they are usually tougher than the original photographic film. Furthermore, dirt can adhere to the chemical coatings, though again they are usually easier to clean than the photo film itself. In some instance, sleeves of plastic film have been used to encapsulate the photo strips before they are delivered to their owners. These expedients, however, provide only limited protection when the photo strips are in the hands of the consumer. In general, they are relatively expensive to apply and are likely to interfere with a continuous production flow in a film processing operation.

SUMMARY OF THE INVENTION

It is an object of the present invention, therefore, to provide a new and improved method for protecting a photo strip that is simple and inexpensive, that does not interfere with a continuous production flow in a photo film processing operation, yet provides better protection for the photo strip than previously known techniques.

Another object of the invention is to provide a new and improved photographic product, comprising a photo strip of multiple frames or exposures, that is effectively protected against marring, scratching, and dirt accumulation by means of a removable shield that is simple and inexpensive, that does not inhibit continuous production flow in a film processing operation, and that affords better protection to the film strip than previously known techniques.

Accordingly, in one aspect the invention relates to a method of protecting a photo strip of predetermined overall length and width, including a sequence of individual image frames of given width distributed at spaced intervals longitudinally of the photo strip, the photo strip having at least one row of sprocket holes along one side of the photo strip between the image frames and the edge of the photo strip. The method precludes engagement of adhesive within any image frame and allows removal of surface protection for uninhibited reproduction of images from the film strip. The method comprises the steps of:

forming two transparent strips of protective film, each protective film strip having a width less than the width of the photo strip and a length at least sufficient to cover all image frames of the photo strip, and each protective film strip having two narrow pressure sensitive releasable adhesive stripes along opposite edges on one surface of the protective film strip, the adhesive stripes on each protecting film strip being separated by a distance greater than the image frame width; and applying the two protective film strips in aligned relation to opposite surfaces of the photo strip, with their adhesive stripes facing toward and adhering to the photo strip and one adhesive stripe on each protective film strip aligned over the perforations in the photo strip, so that an edge portion, not covered by either transparent protective film strip, remains on at least one edge of the photo strip.

In another aspect, the invention relates to a protected photographic product comprising a photo strip of predetermined overall length and width including a sequence of individual image frames of given width distributed at space intervals longitudinally of the photo strip, the photo strip having at least one row of sprocket holes along one side of the photo strip between the image frames and the edge of the photo strip. The product further comprises two transparent strips of protective film, each protective film strip having a width less than the width of the photo strip and a length at least sufficient to cover all image frames of the photo strip; each protective film strip has two narrow pressure sensitive releasable adhesive stripes along opposie edges on one surface of the protective film strip, the adhesive stripes on each protective film strip being separated by a distance greater than the image frame width to preclude engagement of the adhesive with the area in any image frame. The two protective film strips are affixed to opposite surfaces of the photo strip, with their adhesive stripes facing toward and adhered to the photo strip, one adhesive stripe on each protective film strip being aligned over the perforations in the photo strip so that an edge portion, not covered by either protective film strip, remains on at least one edge of the photo strip. The protective film strips are readily removable for uninhibited reproduction of images from the photo strip.

DESCRIPTION OF THE PREFERRED EMBODIMENTS

Figure 1:
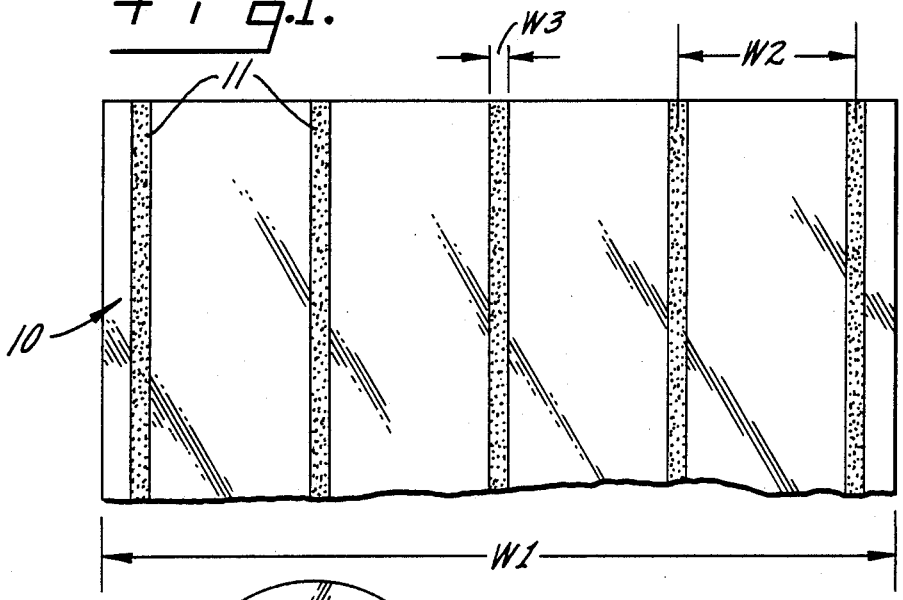
FIG. 1 is a plan view of a web of transparent protective film used in the invention.

FIG. 1 illustrates a preliminary step that may be utilized in forming transparent strips of protective film for use in the method and product of the present invention. FIG. 1 shows a short length of a long web 10 of a transparent film. A variety of different films could be used as film 10, so long as they are relatively hard, tough, and capable of withstanding appreciable abuse. The preferred material for web 10 and for the transparent protective film strips fabricated from that web is biaxially oriented transparent polystyrene having a thickness of about 0.0025 inch (0.064 mm). An appreciable thickness range, as from 0.001 inch (0.025 mm) to 0.004 inch (0.102 mm) is permissible. Thin films of other transparent materials, particularly clear polypropylene and clear acetate, can be used as desired.

In the form illustrated in FIG. 1, the web 10 of transparent protective film has a width W1 of 5.125 inches (130 mm). One side of film 10 is printed or coated with five individual stripes 11 of a pressure sensitive releasable adhesive, the center-to-center spacing W2 between adjacent stripes 11 being 1.16 inch (29.4 mm). With respect to the dimensions included in this specification, it should be understood that they apply essentially to the photographic film employed in a conventional 35 mm camera. All of the dimensions for the transparent films must be tailored to the dimensions of the photo film with which they are employed.

The adhesive selected for stripes 11 must have a balance of tack and peel adhesion that enables the adhesive to adhere readily to a conventional photo film but that also permits ready release and removal from the photo film when needed. The adhesive could be pigmented but preferably is clear and transparent. The adhesive selected should be one that has no detrimental effect on the materials used in conventional photo films or in the images on those films even though, when properly applied, it does not come in contact with any portions of the images. The adhesive selected for stripes 11 may be a water base variety or of a type cured by ultraviolet light. A preferred adhesive is a removable type, waterborne acrylic pressure sensitive adhesive. One acceptable adhesive of this type is Rohm & Haas E-2220. Other adhesives having the properties noted above may be utilized as desired. Each stripe 11 preferably has a width W3 of approximately 0.125 inch (3.2 mm) for a protective film to be used with 35 mm photo film.

When the adhesive stripes 11 have been printed or otherwise coated on one surface of transparent film 10, as shown in FIG. 1, that film is slit longitudinally along the center lines of the adhesive stripes. The resulting transparent film strips are rolled up, producing the form shown in FIG. 2 as a roll 12 of an elongated strip of transparent protective film. Assuming that transparent film strip 12 is to be utilized with 35 mm film, its overall width W2 is preferably about 1.16 inch (29.4 mm) and the width W4 for the stripes 11A of adhesive on the opposite edges of the film strip is approximately 1/16 inch (1.6 mm).

Figure 2:
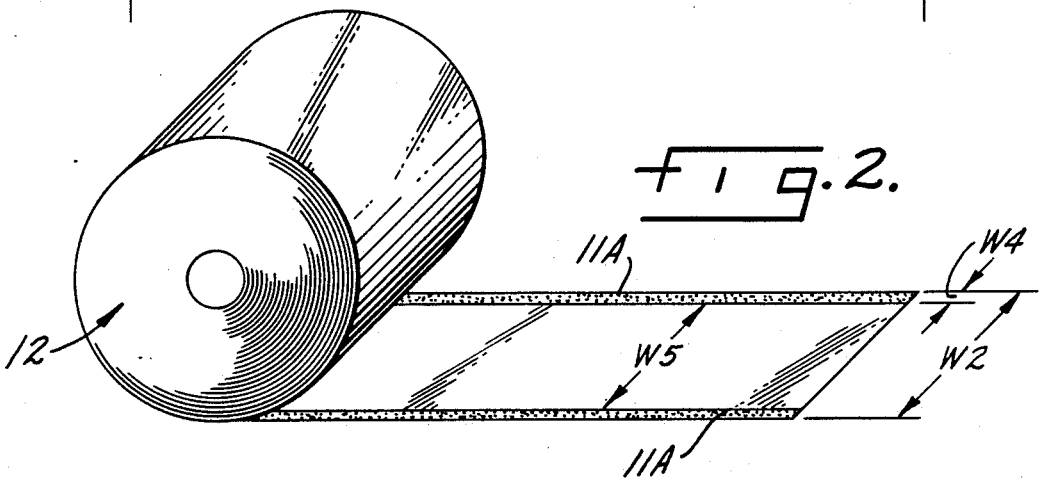
FIG. 2 is a perspective view of a strip of transparent protective film derived from the web illustrated in FIG. 1.
Figure 3:
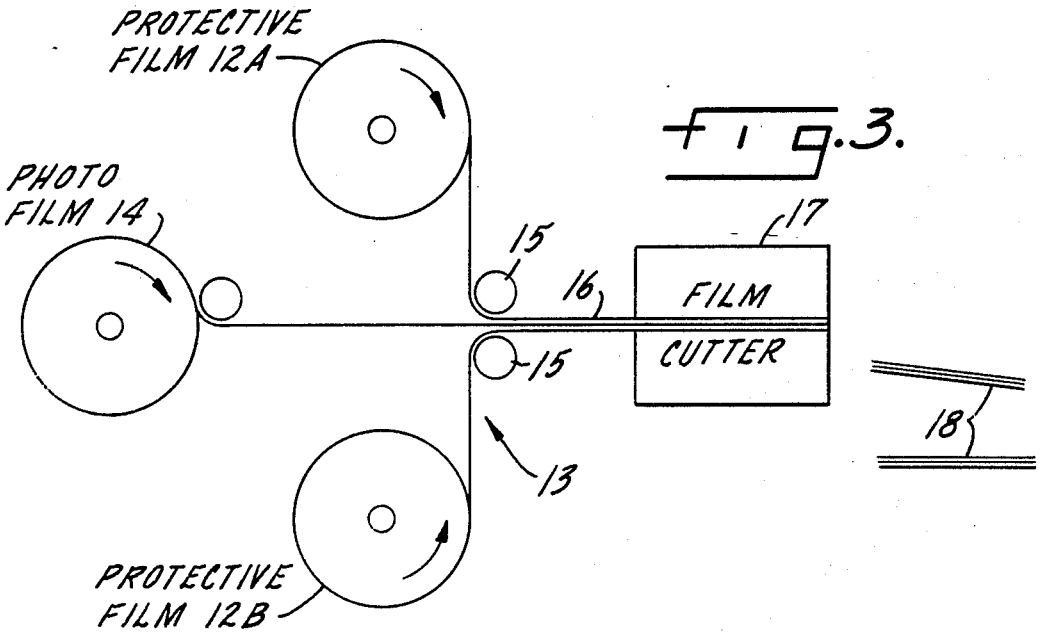
FIG. 3 is a schematic illustration of apparatus utilized in carrying out the method of the invention.

FIG. 3 illustrates, in schematic form, an apparatus 13 that may be utilized in carrying out the method of the present invention subsequent to formation of the protective film strips 12 as illustrated in FIG. 2. Apparatus 13 includes two supply reels 12A and 12B, each of which stores a substantial quantity of the adhesive-striped transparent film in the form of a strip 12 as shown in FIG. 2. The two protective film strips 12A and 12B are fed between a pair of pressure rolls 15 located on opposite sides of a photo film strip supplied from a reel 14. The photo film strip from reel 14 is a composite strip of developed films, from which appropriate prints or slides have been made, ready for final processing and delivery to the consumer. Usually, a sequence of such photo films is connected together for continuous processing in the film development facility.

The adhesive stripes on the protective films from supplies 12A and 12B are on the left-hand surfaces of the films in the vertical runs, as seen in FIG. 3, so that in each instance the adhesive stripes engage the surface of the photo film from supply 14. Consequently, because the adhesive used is pressure sensitive, the product emerging from pressure rolls 15 is a laminate 16 with the two transparent protective film strips on opposite sides of the photo film. This laminate 16 is fed into a conventional automated film cutter 17 in which it is cut into predetermined lengths. Thus, the output from film cutter 17 is a series of protected photographic products 18, each comprising a photo strip of predetermined overall length and width with a given sequence of individual image frames on that strip. Each protected photographic product 18 further includes two transparent strips of protective film, on the opposite surfaces of the photo strip, the protective film being bound to the photo strip by the previously described adhesive stripes.

Figure 4:
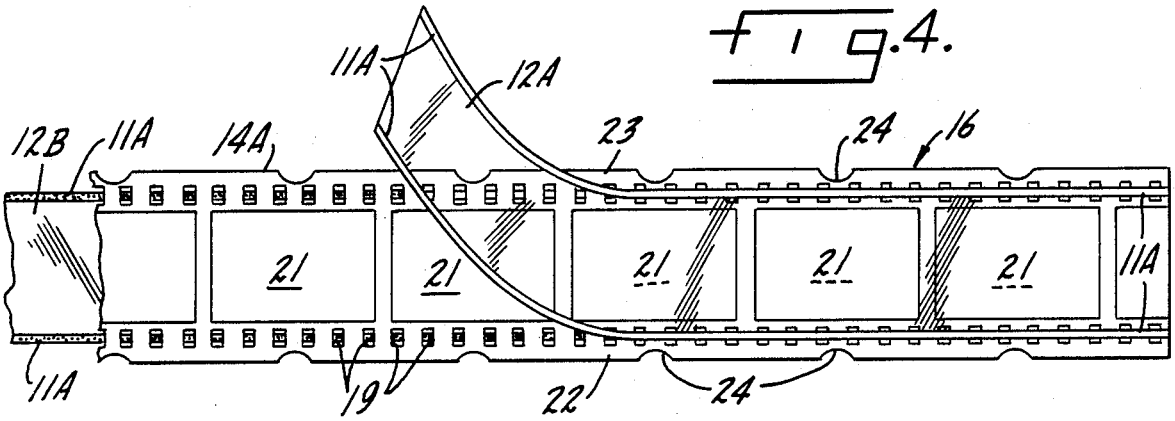
FIG. 4 illustrates the alignment of elements in the product of the invention.
Figure 5:
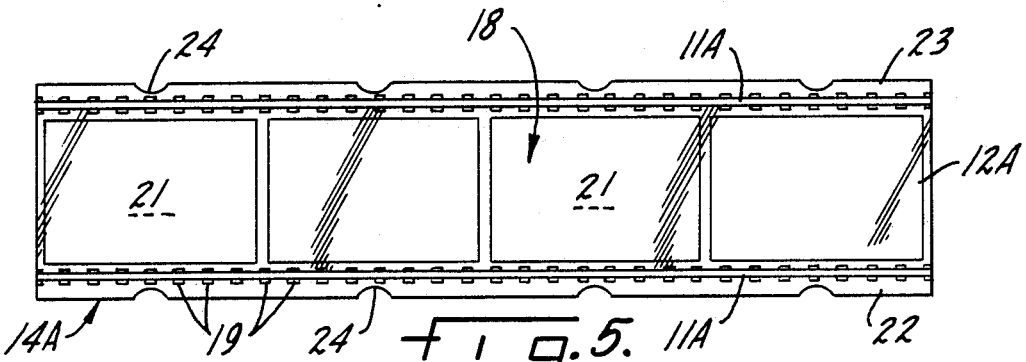
FIG. 5 illustrates the finished product of the invention.

FIG. 4 shows how the two transparent protected film strips 12A and 12B engage photo film 14A to form laminate 16. As is apparent from FIG. 4, each of the protective film strips 12A and 12B has a width less than the width of photo strip 14A, and the length is sufficient to cover all of the web 14A of photo film. When cut off by cutter 17 (FIG. 3), the final product is a series of protected photo strips like the strip 18 shown in FIG. 5. As seen in FIGS. 4 and 5, the adhesive stripes 11A on the two protective films are aligned with and cover most of the usual sprocket holes 19 in the photo film. The adhesive stripes do not extend into any part of the individual image frames 21 on the photo film. In the completed protected photo strip 18 of FIG. 5, there are four images or frames 21; it should be understood that this number can be varied in accordance with the conventional practices regarding the photo film under process. The edges 22 and 23 are not covered by protective strips 12A or 12B; these uncovered edges 22 and 23 of photo film 14A include indexing notches 24 that enable film cutter 17 (FIG. 3) to carry out its task effectively.

It is preferred that these notches 24 not be obscured or covered in any way by the transparent protective films 12A and 12B applied to the photo film 14 in order to avoid interference with operation of film cutter 17.

Figure 6:
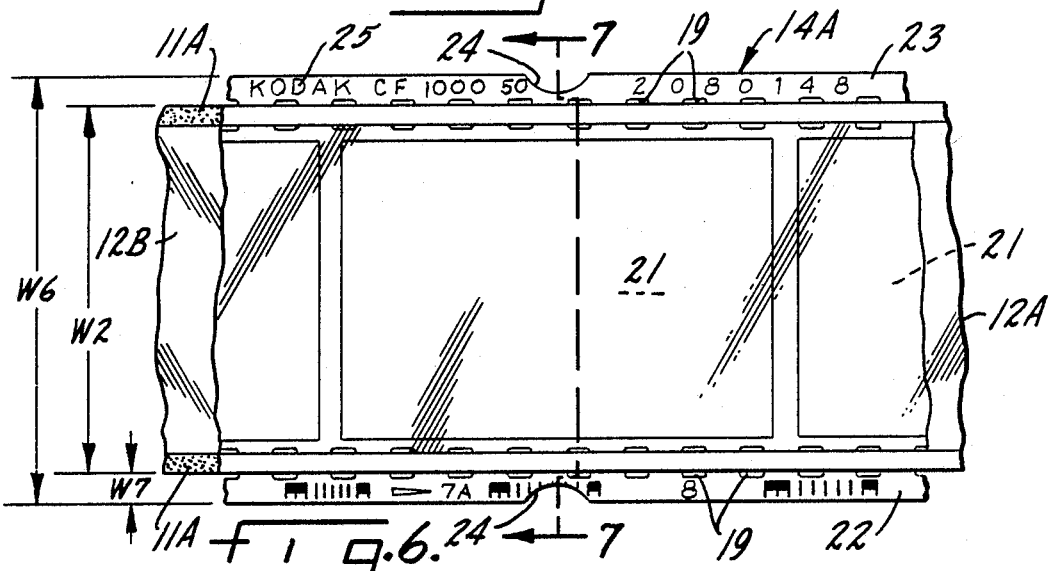
FIG. 6 is an enlarged illustration of a single image frame from the product appearing in FIGS. 4 and 5.

As shown in the enlarged view of FIG. 6, the overall width W6 of photo film 14A is appreciably larger than the width of the protective films 12A and 12B. For 35 mm film, of course, width W6 is 35 mm. With a width W2 for the protective films of 29.4 mm, this leaves an uncovered width W7, at each edge of the photo film, of approximately 2.8 mm. This is adequate to protect the integrity of notches 24 and any printed data 25 along the edges of the photo film, outside of sprocket apertures 19.

Figure 7:
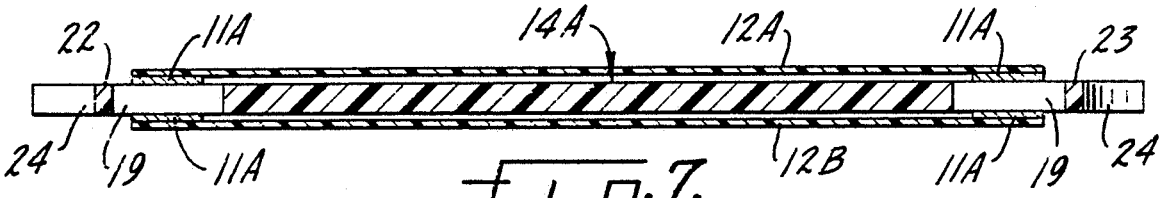
FIG. 7 is a further enlarged detail sectional view taken approximately as indicated by Line 7—7 in FIG. 6.

Photo strips 18, as sent to the consumer, are each protected on both surfaces by the transparent films 12A and 12B, FIGS. 5–7. The adhesive stripes 11A that effectively laminate the protective transparent films to the photo films do not interfere with the notches 24 or legends 25 along the edges of the photo film. The images 21 on the photo film are easily viewed through the transparent films 12A and 12B, allowing selection for further reproduction at any time. On the other hand, those same images are thoroughly protected against scratches, dirt accumulation, or any other damage.

When the time comes that one or more images from the photo strip 18 are to be reproduced again, whether as a print or a transparency, it is a simple matter to peel off the two transparent protective films 12A and 12B. The photo film is then used in the usual manner to make the desired reproductions and thereafter can again be protected within two new films 12A and 12B. The adhesive stripes 11A do not interfere in any way with the normal functioning of the photo film; indeed, the protective shield formed by films 12A and 12B tends to maintain and enhance flatness for the photo film. Because the initial lamination of the protective transparent strips to the photo film strip is performed as an adjunct to the film cutting operation, the entire procedure is readily maintainable as part of a continuous film processing operation and hence is quite cost effective.

We claim:

1. A method of protecting a photo strip of predetermined overall length and width, including a sequence of individual image frames of given width distributed at spaced intervals longitudinally of the photo strip, the photo strip having at least one row of sprocket holes along one side of the photo strip between the image frames and the edge of the photo strip, which method precludes engagement of adhesive within any image frame and allows removal of surface protection for uninhibited reproduction of images from the film strip, the method comprising:

forming two transparent strips of protective film, each protective film strip having a width less than the width of the photo strip and a length at least sufficient to cover all image frames of the photo strip, and each protective film strip having two narrow pressure sensitive releasable adhesive stripes along opposite edges on one surface of the protective film strip, the adhesive stripes on each protective film strip being separated by a distance greater than the image frame width; and applying the two protective film strips in aligned relation to opposite surfaces of the photo strip, with their adhesive stripes facing toward and adhering to the photo strip and one adhesive stripe on each protective film strip aligned over the perforations in the photo strip, so that an edge portion, not covered by either transparent protective film strip, remains on at least one edge of the photo strip.

2. A method of protecting a photo strip according to claim 1 in which uncovered edge portions, projecting beyond both transparent protective film strips, are left along both edges of the photo strip.

3. A method of protecting a photo strip according to claim 1 in which the transparent protective film strips are formed of an oriented transparent film having a thickness of 0.001 inch (0.025 mm) to 0.004 inch (0.102 mm).

4. A method of protecting a photo strip according to claim 1 in which the transparent protective film strips are formed of a biaxially oriented transparent polystyrene film.

5. A method of protecting a photo strip according to claim 4 in which the protective films have a thickness of approximately 0.0025 inch (0.064 mm).

6. A method of protecting a photo strip according to claim 1 in which the adhesive stripes on each protective film strip have a width of the order of 1/16 inch (1.6 mm).

7. A method of protecting a photo strip according to claim 1 in which the adhesive stripes on the protective film strips are a removable, waterborne acrylic pressure sensitive adhesive.

8. A method of protecting a photo strip according to claim 7 in which the adhesive stripes on each protective film strip have a width of the order of 1/16 inch (1.6).

9. A method of protecting a photo strip according to claim 8 in which the transparent protective film strips are formed of biaxially oriented transparent polystyrene film having a thickness of 0.001 inch (0.025 mm) to 0.004 inch (0.102 mm).

10. A method of protecting a photo strip according to claim 1 in which the photo strip is a longitudinal segment of a continuous photo film including a plurality of such photo strips, and in which:

the two transparent protective film strips as formed are in rolls, each much longer than the photo strip;

the two protective film strips are pressed against and adhered to opposed surfaces of the photo film in a progressive lamination operation; and the protected photo film strip is cut from the continuous photo film after lamination.

11. A method of protecting a photo strip according to claim 10 in which uncovered edge portions, projecting beyond both transparent protective film strips, are left along both edges of the continuous photo film.

12. A method of protecting a photo strip according to claim 10 in which the transparent protective film strips are formed of an oriented transparent film having a thickness of 0.001 inch (0.025 mm) to 0.004 inch (0.102 mm).

13. A method of protecting a photo strip according to claim 10 in which the transparent protective film strips are formed of a biaxially oriented transparent polystyrene film.

14. A method of protecting a photo strip according to claim 13 in which the protective films have a thickness of approximately 0.0025 inch (0.064 mm).

15. A method of protecting a photo strip according to claim 10 in which the adhesive stripes on each protective film strip have a width of the order of 1/16 inch (1.6 mm).

16. A method of protecting a photo strip according to claim 10 in which the adhesive stripes on the protective film strips are a removable, waterborne acrylic pressure sensitive adhesive.

17. A method of protecting a photo strip according to claim 16 in which the adhesive stripes on each protective film strip have a width of the order of 1/16 inch (1.6 mm).

18. A method of protecting a photo strip according to claim 17 in which the transparent protective film strips are formed of biaxially oriented transparent polystyrene film having a thickness of 0.001 inch (0.025 mm) to 0.004 inch (0.102 mm).

19. A protected photographic product comprising: a photo strip of predetermined overall length and width including a sequence of individual image frames of given width distributed at spaced intervals longitudinally of the photo strip, the photo strip having at least one row of sprocket holes along one side of the photo strip between the image frames and the edge of the strip;

two transparent strips of protective film, each protective film strip having a width less than the width of the photo strip and a length at least sufficient to cover all image frames of the photo strip;

each protective film strip having two narrow pressure sensitive releasable adhesive stripes along opposite edges on one surface of the protective film strip, the adhesive stripes on each protective film strip being separated by a distance greater than the image frame width to preclude engagement of the adhesive with the area in any image frame;

the two protective film strips being releasably affixed to opposite surfaces of the photo strip, with their adhesive stripes facing toward and adhered to the photo strip, one adhesive stripe on each protective film strip being aligned over the perforations in the photo strip so that an edge portion, not covered by either protective film strip, remains exposed on at least one edge of the photo strip;

and the protective film strips are readily removable for uninhibited reproduction of images from the photo strip.

20. A protected photographic product according to claim 19 in which, in the finished product, edge portions, not covered by either protective film strip, remain along both edges of the photo strip.

21. A protected photographic product according to claim 20 in which the lengths of all three strips are equal to each other.

22. A protected photographic product according to claim 19 in which the transparent protective film strips are of an oriented transparent film having a thickness of 0.001 inch (0.025 mm) to 0.004 inch (0.102 mm).

23. A protected photographic product according to claim 19 in which the transparent protective film strips are a biaxially oriented transparent polystyrene film.

24. A protected photographic product according to claim 23 in which the protective films have a thickness of approximately 0.0025 inch (0.064 mm).

25. A protected photographic product according to claim 19 in which the adhesive stripes on each protective film strip have a width of the order of 1/16 inch (1.6 mm).

26. A protected photographic product according to claim 19 in which the adhesive stripes on the protective film strips are a removable, waterborne acrylic pressure sensitive adhesive.

27. A protected photographic product according to claim 26 in which the adhesive stripes on each protective film strip have a width of the order of 1/16 inch (1.6 mm).

28. A protected photographic product according to claim 19 in which the transparent protective film strips are biaxially oriented transparent polystyrene film having a thickness of 0.001 inch (0.025 mm) to 0.004 inch (0.102 mm).

* * * * *